US006425334B1

(12) United States Patent
Wronkiewicz et al.

(10) Patent No.: US 6,425,334 B1
(45) Date of Patent: Jul. 30, 2002

(54) FRICTION SHOE FOR FREIGHT CAR TRUCK

(75) Inventors: Robert D. Wronkiewicz, Park Ridge; Scott K. Pierson, Mokena, both of IL (US)

(73) Assignee: AMSTED Industries Incorporated, Chicago, IL (US)

( * ) Notice: Subject to any disclaimer, the term of this patent is extended or adjusted under 35 U.S.C. 154(b) by 0 days.

(21) Appl. No.: 09/743,000

(22) Filed: Dec. 20, 2000

(51) Int. Cl.[7] ..... B61F 5/00

(52) U.S. Cl. ..... 105/198.4; 105/198.2; 105/198.5

(58) Field of Search ..... 105/182.1, 198.2, 105/198.4, 198.5, 206.1, 207, 225

(56) References Cited

U.S. PATENT DOCUMENTS 3,559,589 A * 2/1971 Williams ..... 105/198.2
3,802,353 A * 4/1974 Korpics ..... 105/207
4,084,514 A * 4/1978 Bullock ..... 105/206.1
4,167,907 A * 9/1979 Mulcahy et al. ..... 105/198.2
4,254,713 A * 3/1981 Clafford ..... 105/198.2
4,256,041 A * 3/1981 Kemper et al. ..... 105/198.2
4,426,934 A * 1/1984 Geyer ..... 105/198.2
4,637,319 A * 1/1987 Moehling et al. ..... 105/207
4,825,776 A * 5/1989 Spencer ..... 105/198.5
4,915,031 A * 4/1990 Wiebe ..... 105/198.2
4,953,471 A * 9/1990 Wronkiewicz et al. .. 105/198.4
4,986,192 A * 1/1991 Wiebe ..... 105/198.4
5,086,708 A * 2/1992 McKeown, Jr. et al. .... 105/207
5,095,823 A * 3/1992 McKeown, Jr. ..... 105/198.2
5,452,665 A * 9/1995 Wronkiewicz et al. .. 105/198.2
5,524,551 A * 6/1996 Hawthorne et al. ..... 105/198.4
5,943,961 A * 8/1999 Rudibaugh et al. ..... 105/198.2

* cited by examiner

*Primary Examiner*—S. Joseph Morano
*Assistant Examiner*—Lars A. Olson
(74) *Attorney, Agent, or Firm*—Edward J. Brosius

(57) ABSTRACT

A friction shoe is provided for use in a railway freight car truck. A freight car truck comprises two laterally spaced sideframes with a bolster extending transversely between said sideframes. The bolster has two ends each of which extends into an opening in each sideframe and is supported by a spring group in each sideframe opening. A friction shoe is provided in a sloped pocket between each bolster end and a vertical face of the sideframe. The friction shoes are themselves comprised of a sloped wall, a vertical rear wall extending from a lower part of the rear wall to a lower part of the sloped wall, and side support walls. The friction shoe provides damping for the bolster supported on each spring group. The friction shoe of the present invention also includes generally circular openings in the side support walls.

7 Claims, 2 Drawing Sheets

FRICTION SHOE FOR FREIGHT CAR TRUCK

BACKGROUND OF THE INVENTION

The present invention relates to a damping or snubbing arrangement for a railway freight car truck and, more particularly, to a single sloped wedge surface friction shoe for use in a variable damped railway freight car truck snubbing interface between the bolster ends and the sideframe bolster opening.

As set forth in U.S. Pat. Nos. 4,426,934 and 4,637,319, a typical three piece railway freight car truck in service today comprises two laterally spaced sideframes that are typically of an integral cast steel construction, and a bolster extending transversely between such sideframes. The bolster is also typically of an integral cast steel construction. The ends of the bolster are supported on spring groups with the weight of the freight car itself supported on the center plate and side bearings of the bolster top surface. The axle and wheel sets are received in pedestal jaws at each end of the longitudinally aligned sideframes.

As the railway freight car travels down the railroad track, the car is subjected to typical vertical and horizontal component forces that cause the bolster to travel vertically within the sideframe bolster openings. Such motion is absorbed by the spring groups within the sideframe openings. The lower ends of the springs are supported on the spring group support surface of the sideframe with the upper ends of the springs supporting the bottom surface of the bolster ends.

It is necessary to provide snubbing or damping for the bolster so that the motion of the bolster is restricted. Such damping is provided by friction shoes that are located in a so-called friction shoe pockets formed at the outer ends of the bolster. Each end of the bolster includes two such friction shoe pockets formed by sloped surfaces facing laterally on each side of the bolster end. In the variable damped designed railway truck, the bottom of the friction shoe is supported by a spring or spring group that extends to the sideframe spring support surface. This type of truck is known as a variable damped truck because the compression force from the shoe supporting spring varies during relative vertical motion between the bolster and the sideframe. The friction shoes in such variable damped trucks typically have a single sloped wedge surface extending for the entire lateral width of the friction shoe itself.

A vertical wear plate is typically provided along the sideframe vertical face that contacts the vertical wall of the friction shoe.

As discussed in the two patents mentioned above, undesirable wear along a wall of the bolster friction shoe pocket may occur in such trucks as the cast iron friction shoe rubs against the wall during relative movement between the bolster and sideframe. Such wear may eventually create a condition causing the friction shoe to wear in and hang up or lock up thereby restricting the damped motion of the bolster on the spring group. Such lock up causes the tremendous forces associated from the wheels and axles supporting a loaded railway freight car to be transmitted from the sideframes through the friction shoe directly to the sloped surface of the bolster pocket. This condition can lead to excessive stress conditions, the formation of fatigue cracks, and eventual failure of the bolster end structure.

One arrangement to address this problem is set forth in U.S. Pat. No. 4,426,934 and comprises a wear plate positioned within the bolster friction shoe pocket. The purpose of this wear plate would be to protect the sloped surface of the bolster friction shoe pocket as well as the two lateral walls of such pocket. Such arrangement has not been readily accepted and is difficult to install, as such wear plates traditionally become loose in service and can create a condition which may result in further malfunctioning of the railway freight car truck.

Another solution is set forth in U.S. Pat. No. 4,637,319 to mainly address gouging caused by such cast iron friction shoes. Such shoes include a pin hole to allow assembly of the railway freight car truck. It is necessary to hold the friction shoe in the bolster during assembly or servicing of the truck. A support pin is extended through the pin holes in the bolster friction shoe pocket and through the friction shoe itself to allow the friction shoe to be held in position. In service, the pin is removed and the shoe moves vertically in its typical snubbing fashion. However, the shoe wears into the outward bolster pocket wall by the movement of the edges of the pin hole of the friction shoe across the bolster outer pocket. A protrusion tracking the outside of the pin hole edges is formed in the pocket wall to eventually lock up the friction shoe. U.S. Pat. No. 4,637,319 provides solution to this problem by providing a recess along the outer bolster friction shoe pocket to thereby allow the friction shoe movement without wear by the accompanying pin hole in the friction shoe itself.

SUMMARY OF THE INVENTION

The present invention provides an improved cast iron or preferably, cast steel friction shoe for use in a snubbing arrangement with a railway freight car truck bolster and sideframe interface.

The friction shoe of the present invention is particularly adapted for use in a variable damped friction snubbing arrangement and railway freight car truck utilizing a variable damped friction shoe arrangement between the bolster end and the sideframe. The friction shoe of the present invention has a unique circular shaped opening on each of the vertical support ribs that will virtually eliminate gouging of the bolster due to edges of the opening wearing into the side walls of the bolster forming the friction shoe pocket. The side walls of the circular opening themselves are tapered.

The reliability of the friction shoe when utilized in a traditional railway freight car truck will also be improved. The friction shoe will not inordinately wear into the cast steel bolster pocket leading to the lock up of the friction shoe and even failure of the bolster itself. Improved safety of railway freight cars utilizing such friction shoes will be readily apparent.

It is a primary object of the present invention to provide an improved friction shoe to provide improved performance in a railway freight car truck.

IN THE DRAWINGS

DETAILED DESCRIPTION OF THE PREFERRED EMBODIMENT

Figure 1:
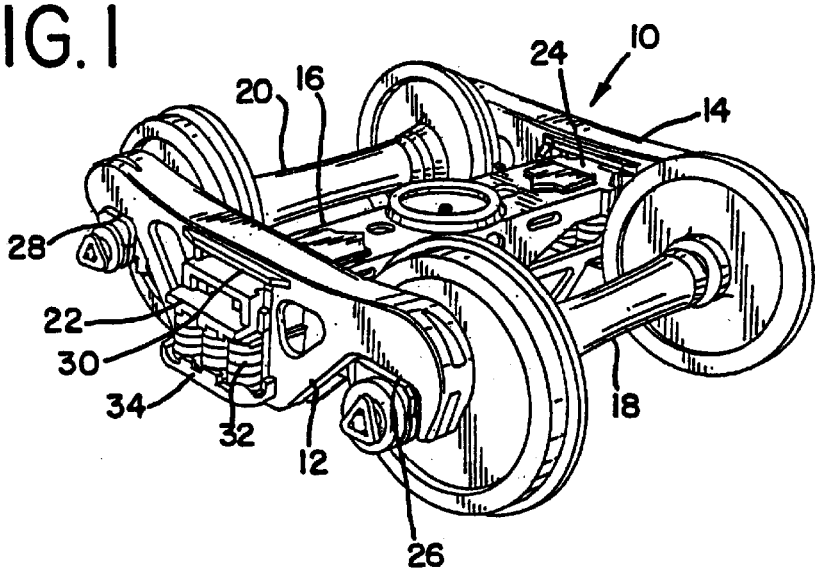
FIG. 1 is a perspective view of a railway freight car truck having a bolster received between two laterally spaced sideframes.

Referring now to FIG. 1 of the drawings, a typical three piece railway freight car truck is shown generally at 10. Railway freight car truck 10 is comprised of cast steel sideframes 12 and 14 that are identical and are laterally spaced from each other. Axle wheel sets 18 and 20 are received in pedestal end openings 26 and 28 of sideframe 12 and similar pedestal end openings of sideframe 14. With the end 22 of bolster 16 extending into and received in sideframe opening 30, a similar end 24 of bolster 16 extends into a similar opening in sideframe 14. Support springs 32 extend upwardly from spring group support section 34 of sideframe 12. A similar spring group extends upwardly from sideframe 14 to support bolster end 24.

Figure 2:
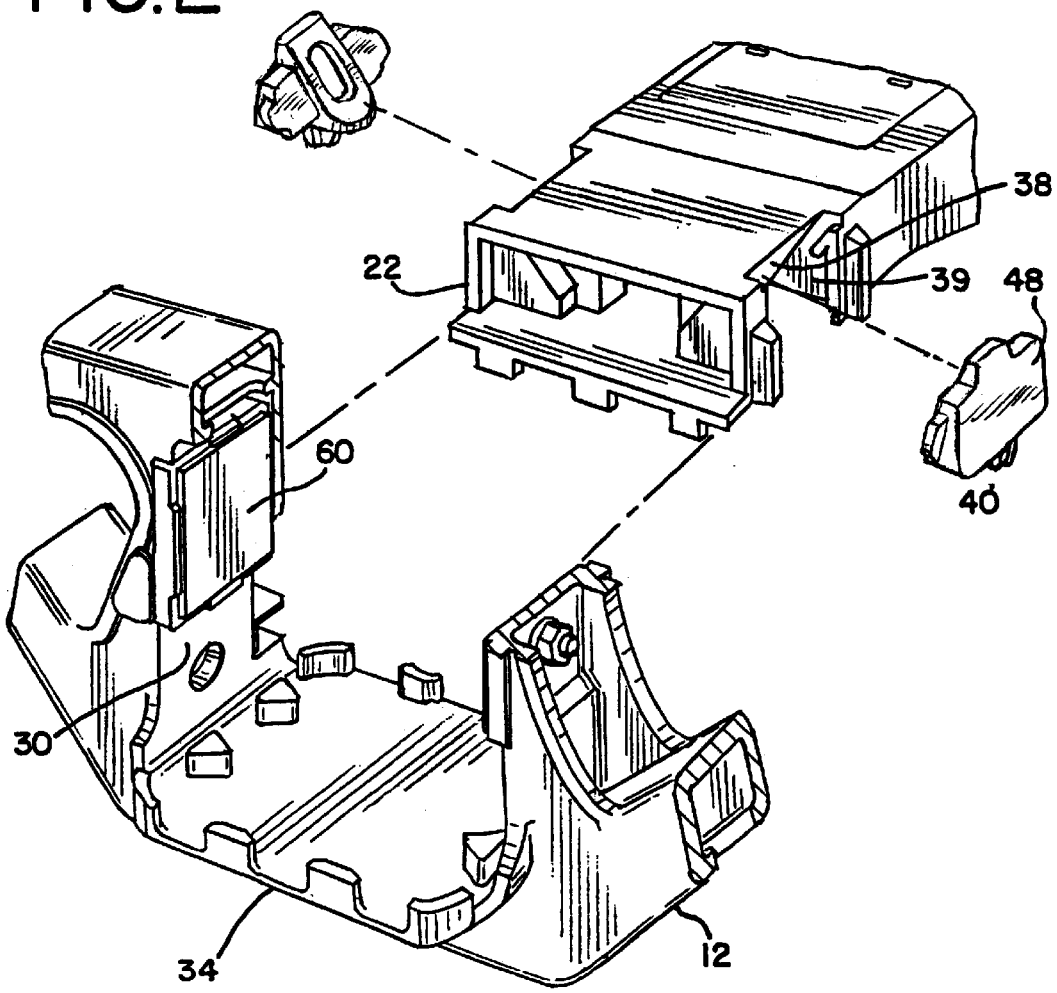
FIG. 2 is an exploded view of the bolster end and sideframe receiving pocket of a variable damped railway freight car truck.
Figure 3:
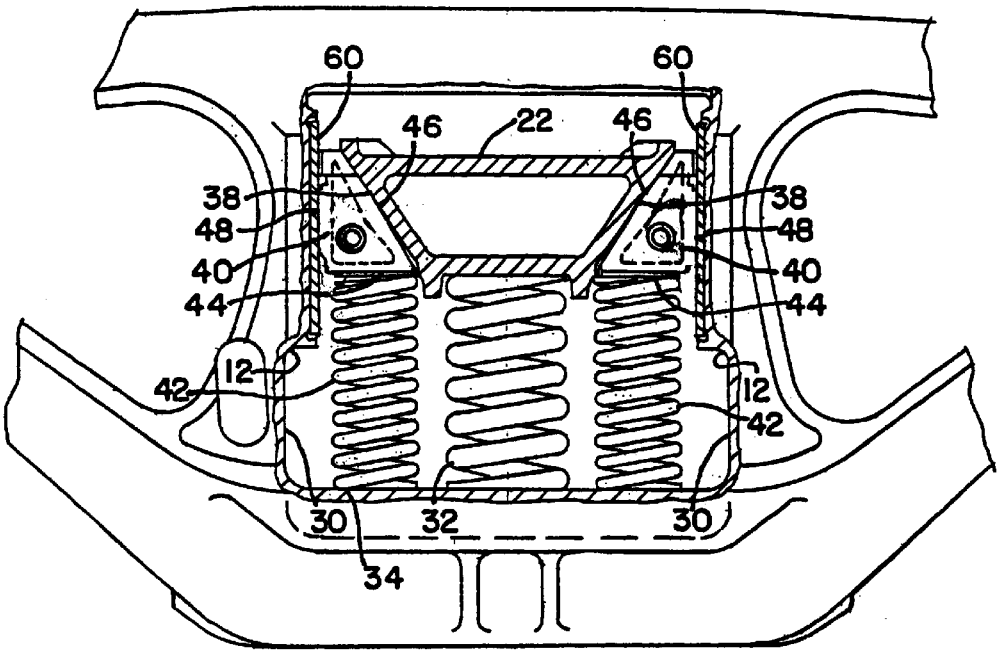
FIG. 3 is an end view and partial cross section of a bolster end received in a sideframe opening of a variable damp railway freight car truck.

Referring now to FIGS. 2 and 3, a detailed view of bolster end 22 supported on spring group 32 extending upwardly from sideframe spring support section 34 is shown. Friction shoe 40 is seen supported by a spring group 42 which itself extends upwardly from sideframe spring group support section 34. The vertical face 48 of friction shoe 40 contacts wear plate 60 which is usually bolted and welded to a receiving section of sideframe 12. It can be readily seen that the forces from spring group 42 vary with the vertical placement of bolster 16 and associated friction shoe 40.

Figure 4:
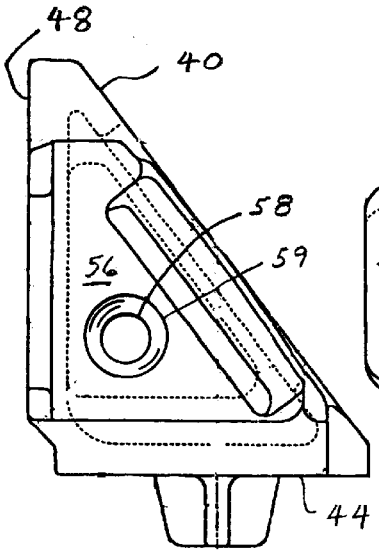
FIG. 4 is a side view of the improved friction shoe of the present invention.
Figure 5:
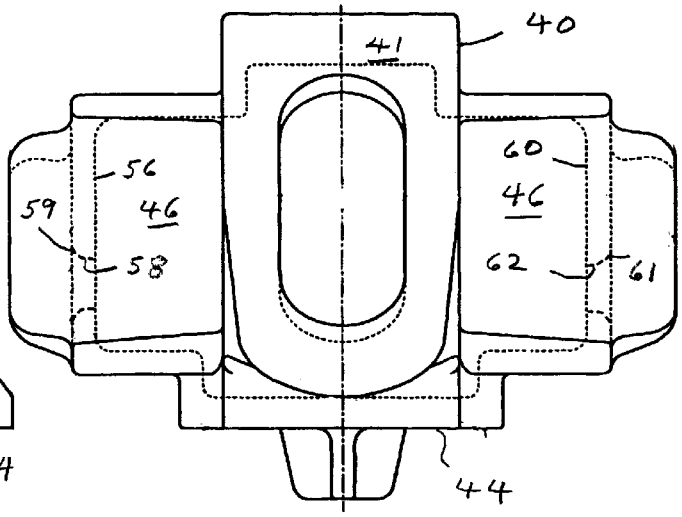
FIG. 5 is a perspective view of the improved friction shoe of the present invention.

Referring now to FIGS. 4 and 5, a detailed view of friction shoe 40 is provided. Friction shoe 40 is comprised of a cast steel material, and is usually a unitary structure. However, for weight savings, a large portion of friction shoe 40 is hollow with appropriate strengthening walls and support ribs. Friction shoe 40 is seen to comprise a generally vertical wall 48 that extends about the entire width of friction shoe 40. A bottom section 44 extends transversely from an intersection with vertical wall 48. A pair of sloped faces 46 extend downwardly from the outer intersections with vertical wall 48 at an acute angle thereof, and outwardly from center section 41 of friction shoe 40. The lower edge of sloped faces 46 intersect with bottom wall 44.

The typical material for friction shoe 40 is an AISI/SAE Grade 1527 cast steel. The chemistry of such steel is as follows: carbon about 0.27% and manganese about 1.6% with a Brinell hardness of 418–512.

External support ribs 56 and 60 generally extend from a laterally central vertical intersection with rear wall 48 to a generally vertical intersection with the inner surface of sloped faces 46, and from bottom wall 44 to the top of friction shoe 40 at the top of the intersection of sloped face 46 and vertical wall 48. Circular shaped opening 58 is located in external support rib 56 and circular shaped opening 62 is located in external support rib 60. Further, each of circular shaped openings 58 and 62 has a tapered wall cross section with a larger diameter near the outer surface of the external support rib. In order to save weight and prevent gouging of the adjacent bolster sidewall 39, external support ribs 56 and 60 each have circular shaped tapered openings formed therein. Opening 58 is in external support rib 56 and opening 62 is in external support rib 60. Further, openings 58 and 62, respectively, have an outer radiused surface 59, 61 between 0.06 and 0.31 in. radius of curvature.

What is claimed is:

1. A friction shoe for use in a railway freight car truck, said friction shoe comprising a vertical rear wall extending for about the entire lateral width of the friction shoe, a sloped wall extending downwardly at an acute angle from a top position of lateral junction with a top position of said vertical rear wall, a bottom section extending from and generally perpendicular to a lower portion of said vertical rear wall to a lower portion of said sloped wall, side walls each extending from outer edges of said vertical real wall, said sloped wall and said bottom section, and two support walls extending from a generally laterally central intersection with an inner surface of said vertical rear wall to a generally laterally central intersection with an inner surface of said sloped wall and from said bottom section to said lateral junction between said sloped wall and said vertical rear wall, wherein each of said support walls has a generally circular shaped opening therein, wherein each of said circular shaped openings has a tapered cross section forming said opening in said support wall.

2. The friction shoe of claim 1 wherein each of said circular shaped openings has larger diameter at an outer surface of the support wall.

3. The friction shoe of claim 1 wherein said friction shoe is comprised of an AISI/SAE Grade 1527 steel with a Brinell hardness of from 418 to 512.

4. The friction shoe of claim 2 wherein each of said circular shaped openings has a radius between 0.06" and 0.31" at said outer surface.

5. A railway freight car truck comprising two laterally spaced sideframes, a bolster extending transversely between said sideframes, said bolster having two ends, each end extending into an opening in each sideframe, a spring group in each sideframe opening to support said bolster end, and a friction shoe comprising a vertical rear wall extending for about the entire lateral width of the friction shoe, a sloped wall extending downwardly at an acute angle from a top position of lateral junction with a top position of said vertical rear wall, a bottom section extending from and generally perpendicular to a lower portion of said vertical rear wall to a lower portion of said sloped wall, side walls each extending from outer edges of said vertical real wall, said sloped wall and said bottom section, and two support walls extending from a generally laterally central intersection with an inner surface of said vertical rear wall to a generally laterally central intersection with an inner surface of said sloped wall, and from said bottom section to said lateral junction between said sloped wall and said vertical rear wall, wherein each of said support walls has a generally circular shaped opening therein, two sloped pockets in each bolster end, each of said sloped pockets comprising a sloping wedge wall, a first lateral wall depending from said sloping wedge wall, a second lateral wall spaced from said first lateral wall and depending from said sloping wedge wall, each of said first and second lateral walls of said bolster sloped pocket having planar inner faces adjacent side walls of said friction shoe, wherein each of said circular shaped openings has a tapered cross section forming said opening in said support wall.

6. The railway freight car truck of claim 5 wherein each of said circular shaped openings has a larger cross sectional diameter at an outer edge of said support wall.

7. The railway freight car truck of claim 6 wherein each of said circular shaped openings has a radius of between 0.06" and 0.31" at said outer edge.

* * * * *